US007369668B1

(12) United States Patent
Huopaniemi et al.

(10) Patent No.: US 7,369,668 B1
(45) Date of Patent: May 6, 2008

(54) METHOD AND SYSTEM FOR PROCESSING DIRECTED SOUND IN AN ACOUSTIC VIRTUAL ENVIRONMENT

(75) Inventors: Jyri Huopaniemi, Helsinki (FI); Riitta Väänänen, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/273,436

(22) Filed: Mar. 22, 1999

(30) Foreign Application Priority Data

Mar. 23, 1998 (FI) ..... 980649

(51) Int. Cl.
*H04R 5/02* (2006.01)
*H04R 5/00* (2006.01)

(52) U.S. Cl. ..... 381/310; 381/18

(58) Field of Classification Search ..... 381/17, 381/18, 19, 22, 23, 310, 61, 309
See application file for complete search history.

(56) References Cited

U.S. PATENT DOCUMENTS

| | | | | |
|---|---|---|---|---|
| 4,731,848 | A | 3/1988 | Kendall et al. | 381/63 |
| 5,285,165 | A | 2/1994 | Renfors et al. | 328/167 |
| 5,293,139 | A | 3/1994 | Polonen et al. | 333/14 |
| 5,350,956 | A | 9/1994 | Gronroos | 307/556 |
| 5,406,635 | A | 4/1995 | Jarvinen | 381/94 |
| 5,485,514 | A | 1/1996 | Knappe et al. | 379/387 |
| 5,502,747 | A | 3/1996 | McGrath | 375/350 |
| 5,581,618 | A | 12/1996 | Satoshi et al. | 381/17 |
| 5,585,587 | A | 12/1996 | Inoue et al. | 84/662 |
| 5,659,619 | A | 8/1997 | Abel | 381/17 |
| 5,684,881 | A | 11/1997 | Serikawa et al. | 381/86 |
| 5,790,957 | A | 8/1998 | Heidari | 455/553 |
| 5,839,101 | A | 11/1998 | Vahatalo et al. | 704/226 |
| 5,907,823 | A | 5/1999 | Sjoberg et al. | 704/225 |
| 6,418,226 | B2 * | 7/2002 | Mukojima | 381/17 |

FOREIGN PATENT DOCUMENTS

| | | |
|---|---|---|
| EP | 0 735 796 A2 | 10/1996 |
| GB | 2 303 019 A | 2/1997 |
| GB | 2 305 092 | 3/1997 |
| GB | 2 305 092 A | 3/1997 |
| WO | WO 98/20706 | 5/1998 |
| WO | WO 99/21164 | 4/1999 |

OTHER PUBLICATIONS

"Auralization—An Overiew", Kleiner et al., 1993, J. Audio Eng. Soc., vol. 41, No. 11, pp. 861-875.
"The Virtual Reality Modeling Language"; VRML 97, Apr. 1997, ISO/IEC JTC/SC24 IS 14772-1, 1997, Information Technology-Computer Graphics and Image Processing.

(Continued)

*Primary Examiner*—Xu Mei
(74) *Attorney, Agent, or Firm*—Perman & Green, LLP

(57) ABSTRACT

An acoustic virtual environment is processed in an electronic device. The acoustic virtual environment comprises at least one sound source (300). In order to model the manner in which the sound is directed, a direction dependent filtering arrangement (306, 307, 308, 309) is attached to the sound source, whereby the effect of the filtering arrangement on the sound depends on predetermined parameters. The directivity can depend on the frequency of the sound.

16 Claims, 5 Drawing Sheets

OTHER PUBLICATIONS

"Java 3D" API Specification, Sun microsystems.
ISO/IEC JTC/SC29/WG11 CD 14496 "Coding of Moving Pictures and Audio".
"Definition of sound source directivity in advance multimedia systems", Huopaniemi et al., Helsinki University of Technology.
Finnish Official Action.
"NNT's Research on Acoustics for Future Telecommunication Services", Miyoshi et al., Applied Acoustics, vol. 36, No. 3-4, 1992 pp. 307-326.
"Physical Models of Musical Instruments in Real-Time Binaural Room Simulation", Houpaniemi, et al, 15th International Congress on Acoustics (ICA '95), Trondheim, Norway, Jun. 26-30, 1995.
"Direction-Dependent Physical Modeling of Musical Instrument", Karjalaomem, et al, 15th International Congress on Acoustics (ICA '95), Trondheim, Norway, Jun. 26-30, 1995.

* cited by examiner

METHOD AND SYSTEM FOR PROCESSING DIRECTED SOUND IN AN ACOUSTIC VIRTUAL ENVIRONMENT

TECHNOLOGICAL FIELD

The invention relates to a method and a system with which an artificial audible impression corresponding to a certain space can be created for a listener. Particularly the invention relates to the processing of directed sound in such an audible impression and to the transmitting of the resulting audible impression in a system where the information presented to the user is transmitted, processed and/or compressed in a digital form.

BACKGROUND OF THE INVENTION

An acoustic virtual environment means an audible impression with the aid of which the listener to an electrically reproduced sound can imagine that he is in a certain space. Complicated acoustic virtual environments often aim at imitating a real space, which is called auralization of said space. This concept is described for instance in the article M. Kleiner, B.-I. Dalenbäck P. Svensson: "Auralization—An Overviews", 1993, J. Audio Eng. Soc., vol. 41, No. 11, pp. 861-875. The auralization can be combined in a natural way with the creation of a visual virtual environment, whereby a user provided with suitable displays and speakers or a headset can examine a desired real or imaginary space, and even "move around" in said space, whereby he gets a different visual and acoustic impression depending on which point in said environment he chooses as his examination point.

The creation of an acoustic virtual environment can be divided into three factors which are the modeling of the sound source, the modeling of the space, and the modeling of the listener. The present invention relates particularly to the modeling of a sound source and the early reflections of the sound.

The VRML97 language (Virtual Reality Modeling Language 97) is often used for modeling and processing a visual and acoustic virtual environment, and this language is treated in the publication ISO/IEC JTC/SC24 IS 14772-1, 1997, Information Technology—Computer Graphics and Image Processing—The Virtual Reality Modeling Language (VRML97), April 1997; and on the corresponding pages at the Internet address http://www.vrml.org/Specifications/VRML97/. Another set of rules being developed while this patent application is being written relates to the Java3D, which is to become the control and processing environment of the VRML, and which is described for instance in the publication SUN Inc. 1997: JAVA 3D API Specification 1.0; and at the Internet address http://www.javasoft.com/-products/java-media/3D/forDevelopers/3Dguide/-. Further the MPEG-4 standard (Motion Picture Expert Group 4) under development has as a goal that a multimedia presentation transmitted via a digital communication link can contain real and virtual objects, which together form a certain audiovisual environment. The MPEG-4 standard is described in the publication ISO/IEC JTC/SC29 WG11 CD 14496. 1997: Information technology—Coding of audiovisual objects. November 1997; and on the corresponding pages at the Internet address http://www.cselt.it/-mpeg/public/mpeg-4_cd.htm.

FIG. 1 shows a known directed sound model which is used in VRML97 and MPEG-4. The sound source is located at the point 101 and around it there is imagined two ellipsoids 102 and 103 within each other, whereby the focus of one ellipsoid is common with the location of the sound source and whereby the main axes of the ellipsoids are parallel. The sizes of the ellipsoids 102 and 104 are represented by the distances maxBack, maxFront, minBack and minFront measured in the direction of the ma axis. The attenuation of the sound as a function of the distance is represented by the curve 104. Inside the inner ellipsoid 102 the sound intensity is constant, and outside the outer ellipsoid 103 the sound intensity is zero. When passing along any straight line through the point 101 away from the point 101 the sound intensity decreases linearly 20 dB between the inner and the outer ellipsoids. In other words, the attenuation A observed at a point 105 located between the ellipsoids can be calculated from the formula $$A=-20\ \text{dB}\cdot(d'/d'')$$

where d' is the distance from the surface of the inner ellipsoid to the observation point, as measured along the straight line joining the points 101 and 105, and d" is the distance between the inner and outer ellipsoids, as measured along the same straight line.

In Java3D directed sound is modeled with the ConeSound concept which is illustrated in FIG. 2. The figure presents a section of a certain double cone structure along a plane which contains the common longitudinal axis of the cones. The sound source is located at the common vertex 203 of the cones 201 and 202. Both in the regions of the front cone 201 and of the back cone 202 the sound is uniformly attenuated. Linear interpolation is applied in the region between the cones. In order to calculate the attenuation detected at the observation point 204 you must know the sound intensity without attenuation, the width of the front and back cones, and the angle between the longitudinal axis of the front cone and the straight line joining the points 203 and 204.

A known method for modeling the acoustics of a space comprising surfaces is the image source method, in which the original sound source is given a set of imaginary image sources which are mirror images of the sound source in relation to the reflection surfaces to be examined: one image source is placed behind each reflection surface to be examined, whereby the distance measured directly from this image source to the examination point is the same as the distance from the original sound source via the reflection to the examination point. Further, the sound from the image source arrives at the examination point from the same direction as the real reflected sound. The audible impression is obtained by adding the sounds generated by the image sources.

The prior art methods are very heavy regarding the calculation. If we assume that the virtual environment is transmitted to the user for instance as a broadcast or via a data network, then the receiver of the user should continuously add the sound generated by even thousands of image sources. Moreover, the bases of the calculation always changes when the user decides to change the location of the examination point. Further the known solutions completely ignore the fact that in addition to the direction angle the directivity of the sound strongly depends on its wave-length, in other words, sounds with a different pitch are directed differently.

From the Finnish patent application number 974006 (Nokia Corp.) and the corresponding U.S. patent application Ser. No. 09/174,989 there is known a method and a system for processing an acoustic virtual environment. There the surfaces of the environment to be modeled are represented by filters having a certain frequency response. In order to transmit the modeled environment in digital transmission form it is sufficient to present in some way the transfer functions of all essential surfaces belonging to the environment. However, even this does not take into account the effects which the arrival direction or the pitch of the sound has on the direction of the sound.

SUMMARY

The disclosed embodiments present a method and a system with which an acoustic virtual environment can be transmitted to the user with a reasonable calculation load. In one aspect, the method and a system are able to take into account how the pitch and the arrival direction of the sound affect the direction of the sound.

In one aspect, the disclosed embodiments model the sound source or its early reflection by a parametrized system function where it is possible to set a desired direction of the sound with the aid of different parameters and to take into account how the direction depends on the frequency and on the direction angle.

In one aspect, a method for processing directed sound in an acoustic virtual environment in an electronic device, said acoustic virtual environment comprising at least one sound source, comprises defining a reference direction and a set of selected directions for the at least one sound source, each selected direction differing from said reference direction establishing a direction dependent filtering arrangement having at least one parameter disposed to at least partly determine a filtering effect of the direction dependent filtering arrangement, said at least one parameter enabling the direction dependent filtering arrangement to model how sound emitted by said at least one sound source sounds when listened from a direction that deviates from said reference direction, for each selected direction defining a value (values) of said at least one parameter, and filtering a signal representing the sound emitted by said at least one sound source with the direction dependent filtering arrangement.

In one aspect, a system for processing directed sound in an acoustic virtual environment comprising at least one sound source comprises:

means for defining a reference direction and a set of selected directions for the at least one sound source, each selected direction differing from said reference direction, a direction dependent filtering arrangement disposed to filter a signal representing sound emitted by said at least one sound source, the direction dependent filtering arrangement having at least one parameter disposed to at least partly determine a filtering effect of the direction dependent filtering arrangement, said at least one parameter enabling the direction dependent filtering arrangement to model how the sound emitted by said at least one sound source sounds when listened from a direction that deviates from said reference direction, and means for associating each selected direction with a value (values) of said at least one parameter.

The model of the sound source or the reflection calculated from it comprises direction dependent digital filters. A certain reference direction, called the zero azimuth, is selected for the sound. This direction can be directed in any direction in the acoustic virtual environment. In addition to it a number of other directions are selected, in which it is desired to model how the sound is directed. Also these directions can be selected arbitrarily. Each selected other direction is modeled by digital filter having a transfer function which can be selected either to be frequency dependent or frequency independent. In a case when the examination point is located somewhere else than exactly in a direction represented by a filter it is possible to form different interpolations between the filter transfer functions.

When we want to model sound and how it is directed in a system where the information must be transmitted in a digital form it is necessary to transmit only the data about each transfer function. The receiving device, knowing the desired examination point, determines the sound is directed from the location of the sound source towards the examination point with the aid of the transfer functions it has reconstructed. If the location of the examination point changes in relation to the zero azimuth the receiving device checks how the sound is directed towards the new examination point. There can be several sound sources, whereby the receiving device calculates how the sound is directed from each sound source to the examination point and correspondingly it modifies the sound it reproduces. Then the listener obtains an impression of a correctly positioned listening place, for instance in relation to a virtual orchestra where the instruments are located in different places and where they are directed in different ways.

The simplest alternative to realize direction dependent digital filtering is to attach a certain amplification factor to each selected direction. However, then the pitch of the sound will not be taken into account. In a more advanced alternative the examined frequency band is divided into sub-bands, and for each sub-band there are presented their own amplification factors in the selected directions. In a further advanced version each examined direction is modeled by a general transfer function, for which certain coefficients are indicated which enable the reconstruction of the same transfer functions.

BRIEF DESCRIPTION OF DRAWINGS

Below the invention is described in more detail with reference to preferred embodiments presented as examples and to the enclosed figures, in which.

Figure 1:
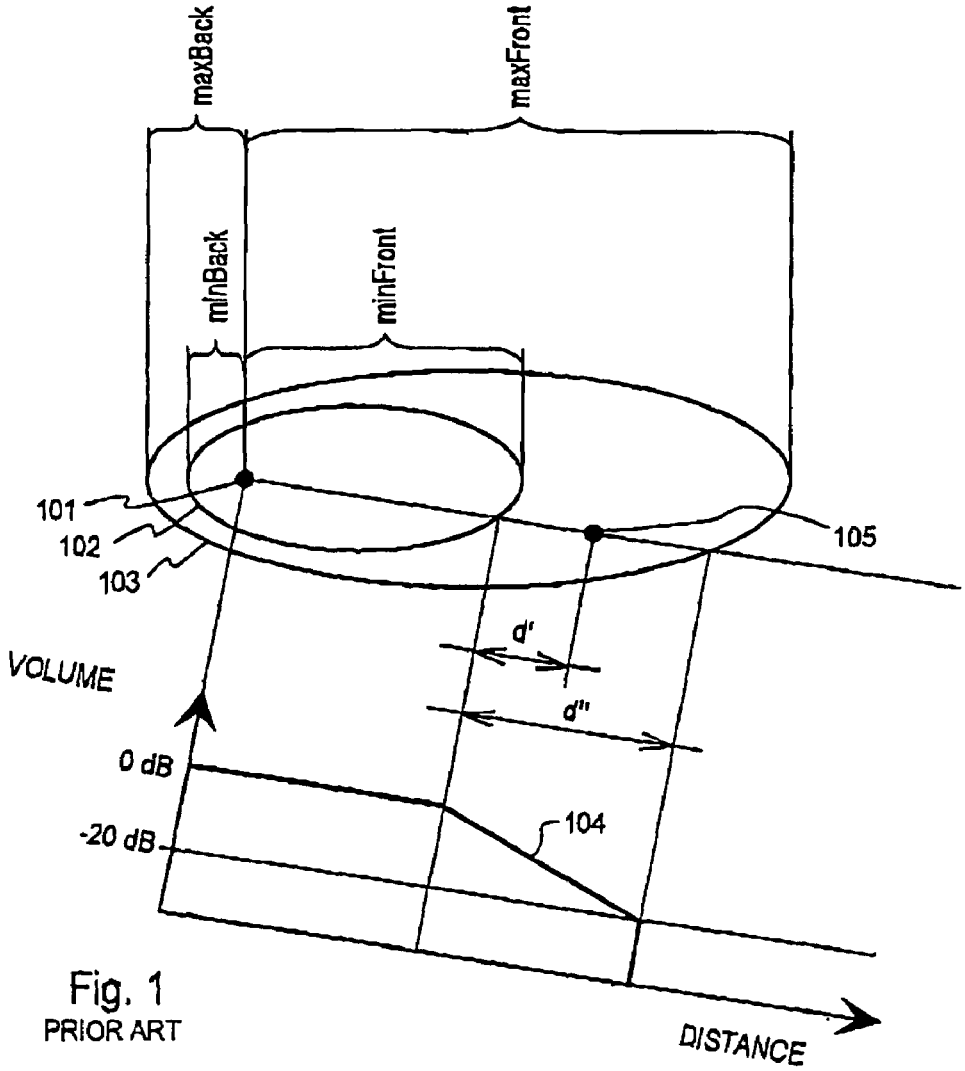
Fig. 1 PRIOR ART
FIG. 1 shows a known directed sound model.
Figure 2:
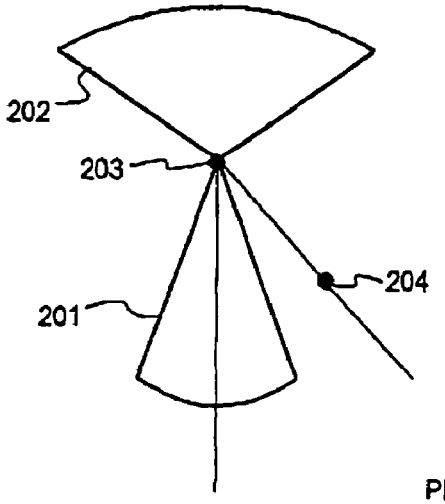
Fig. 2 PRIOR ART
FIG. 2 shows another known directed sound model.

Reference to the FIGS. 1 and 2 was made above in connection with the description of prior art, so in the following description of the invention and its preferred embodiments reference is mainly made to the FIGS. 3 to 7*b*.

DETAILED DESCRIPTION OF THE INVENTION

Figure 3:
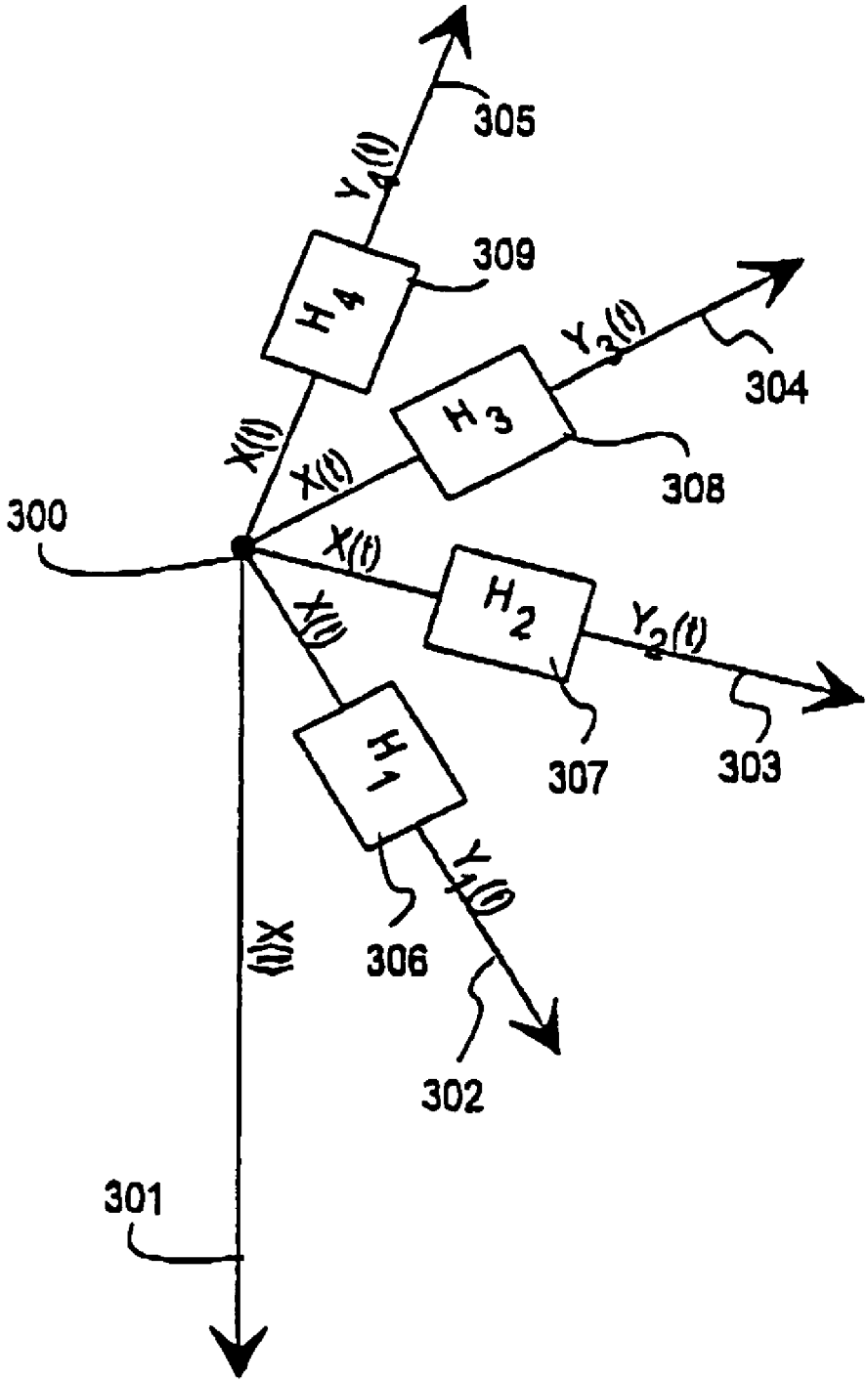
FIG. 3 shows schematically a directed sound model according to the invention.

FIG. 3 shows the location of a sound source in point 300 and the direction 301 of the zero azimuth. In the figure it is assumed that we want to represent the sound source located in point 300 with four filters, of which the first one represents the sound propagating from the sound source in the direction 302, the second one represents the sound propagating from the sound source in the direction 303, the third one represents the sound propagating from the sound source in the direction 304, and the fourth one represents the sound propagating from the sound source in the direction 305. Further it is assumed in the figure that the sound propagates symmetrically in relation to the direction 301 of the zero azimuth, so that in fact each of the directions 302 to 305 represents any corresponding direction on a conical surface which is obtained by rotating the radius representing the examined direction around the direction 301 of the zero azimuth. The invention is not limited to these assumptions, but some features of the invention are more easily understood by considering first a simplified embodiment of the invention. In the figure the directions 302 to 305 are shown as equidistant lines in the same plane, but the directions can as well be selected arbitrarily.

Each filter shown in FIG. 3 and representing the sound propagating in a direction different from the zero azimuth direction is shown symbolically by a block 306, 307, 308 and 309. Each filter is characterized by a certain transfer function $H_i$, where $i \in \{1, 2, 3, 4\}$. The transfer functions of the filters are normalized so that a sound propagating in relation to the zero azimuth is the same as the sound as such generated by the sound source. Because a sound is typically a function of time the sound generated by the sound source is presented as X(t). Each filter 306 to 309 generates a response $Y_i(t)$, where $i \in \{1, 2, 3, 4\}$, according to the equation $$Y_i(t)=H_i*X(t) \tag{1}$$

where * represents convolution in relation to the time. The response $Y_i(t)$ is the sound directed into the direction in question.

In it simplest form the transfer function means that the impulse X(t) is multiplied by a real number. Because it is natural to choose the zero azimuth as that direction in which the strongest sound is directed, then the simplest transfer functions of the filters 306 to 309 are real numbers between zero and one, these limits included.

A simple multiplication by real numbers does not take into account importance of the pitch for the directivity of the sound. A more versatile transfer function is such where the impulse is divided into predetermined frequency bands, and each frequency band is multiplied by its own amplification factor, which is a real number. The frequency bands can be defined by one number which represents the highest frequency of the frequency band. Alternatively certain real number coefficients can now be presented for some example frequencies, whereby a suitable interpolation is applied between these frequencies (for instance, if there is given a frequency of 400 Hz and a factor 0.6; and a frequency of 1000 Hz and a factor is 0.2, then with straightforward interpolation we get the factor 0.4 for the frequency 700 Hz).

Generally it can be stated that each filter 306 to 309 is a certain IIR or FIR filter (Infinite Impulse Response; Finite Impulse Response) having a transfer function H which can be expressed with the aid of a Z-transform H(z). When we take the Z-transform X(t) of the impulse X(t) and the Z-transform Y(t) of the impulse Y(t), then we get the definition $$H(z) = \frac{Y(z)}{X(z)} = \frac{\sum_{k=0}^{M} b_k z^{-k}}{1 + \sum_{k=1}^{N} a_k z^{-k}} \tag{2}$$

whereby it is sufficient to express the coefficients [$b_0$ $b_1$ $a_1$ $b_2$ $a_2$ . . . ] used in modeling the Z-transform in order to express an arbitrary transfer function. The upper limits N and M used in the summing represent that accuracy at which it is desired to define the transfer function. In practice they are determined by how large capacity is available in order to store and/or to transmit in a transmission system the coefficients used to model each single transfer function.

Figure 4:
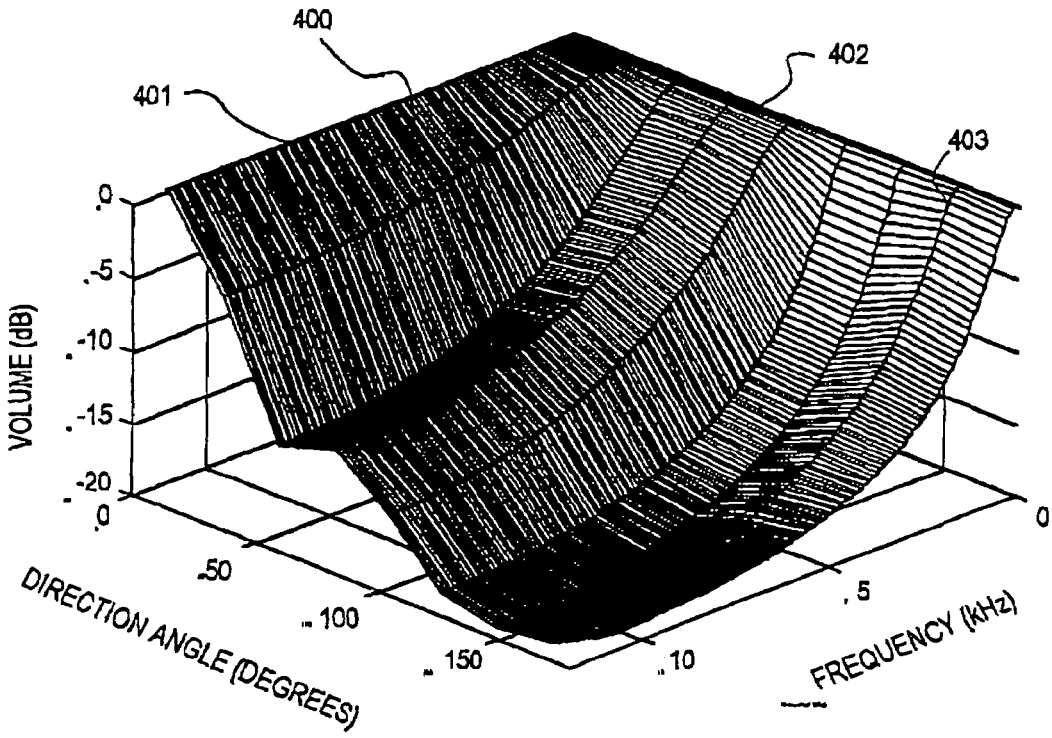
FIG. 4 shows a graphical representation of how the sound is directed, generated by a model according to the invention.

FIG. 4 shows how the sound generated by a trumpet is directed, as expressed by the zero azimuth and according to the invention also with eight frequency dependent transfer functions and interpolations between them. The manner in which the sound is directed is modeled in a three-dimensional coordinate system where the vertical axis represents the sound volume in decibels, the first horizontal axis represents the direction angle in degrees in relation to the zero azimuth, and the second horizontal axis represents the frequency of the sound in kilohertz. Thanks to the interpolations the sound is represented by a surface 400. At the upper left edge of the figure the surface 400 is limited by a horizontal line 401, which expresses that the volume is frequency independent in the zero azimuth direction. At the upper right edge the surface 400 is limited by an almost horizontal line 402, which indicates that the volume does not depend on the direction angle at very low frequencies (at frequencies which approach 0 Hz). The frequency responses of the filters representing different direction angles are curves which start from the line 402 and extend downwards slantingly to the left in the figure. The direction angles are equidistant and their magnitudes are 22.5°, 45°, 67.5°, 90°, 112.5°, 135°, 157.5° and 180°. For instance the curve 403 represents the volume as a function of the frequency regarding the sound which propagates in the angle 157.5° as measured from the zero azimuth, and this curve shows that in this direction the highest frequencies are attenuated more than the low frequencies.

The invention is suitable for the reproduction in local equipment where the acoustic virtual environment is created in the computer memory and processed in the same connection, or it is read from a storage medium, such as a DVD disc (Digital Versatile Disc) and reproduced to the user via audiovisual presentation means (displays, speakers). The invention is further applicable in system where the acoustic virtual environment is generated in the equipment of a so called service provider and transmitted to the user via a transmission system. A device, which to a user reproduces the directed sound processed in a manner according to the invention, and which typically enables the user to select in which point of the acoustic virtual environment he wants to listen to the reproduced sound, is generally called the receiving device. This term is not intended to be limiting regarding the invention.

When the user has given the receiving device information about in which point of the acoustic virtual environment he wants to listen to the reproduced sound, the receiving device determines in which way the sound is directed from the sound source towards said point. In FIG. 4 this means, graphically examined, that when the receiving device has determined the angle between the zero azimuth of the sound source and the direction of the examination point, then it cuts the surface 400 with a vertical plane which is parallel to the frequency axis and cuts the direction angle axis at that value, which indicates the angle between the zero azimuth and the examination point. The section between the surface 400 and said vertical plane is a curve which represents the relative volume of the sound detected in the direction of the examination point as a function of the frequency. The receiving device forms a filter which realizes a frequency response according to said curve, and directs the sound generated by the sound source through the filter which it has formed, before it is reproduced to the user. If the user decides to change the location of the examination point the receiving device determines a new curve and creates a new filter in the manner described above.

Figure 5:
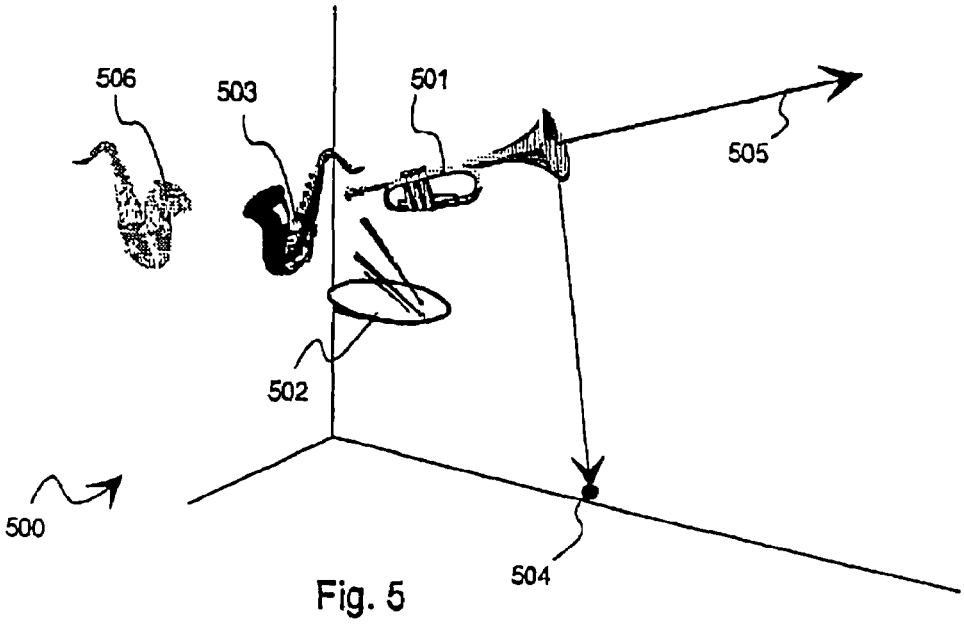
FIG. 5 shows how the invention is applied to an acoustic virtual environment.

FIG. 5 shows an acoustic virtual environment 500 having three virtual sound sources 501, 502 and 503 which are differently directed. The point 504 represents the examination point chosen by the user. In order to explain the situation shown in FIG. 5 there is created according to the invention for each sound source 501, 502 and 503 an own model representing how the sound is directed, whereby the model in each case can be roughly according to the FIGS. 3 and 4, however, talking into account that the zero azimuth has a different direction for each virtual sound source in the model. In this case the receiving device must create three separate filters in order to take into account how the sound is directed. In order to create the first filter there are determined those transfer functions which model how the sound transmitted by the first sound source is directed, and with the aid of these and an interpolation there is created a surface according to FIG. 4. Further there is determined the angle between the direction of the examination point and the zero azimuth 505 of the sound source 501, and with the aid of this angle we can read the frequency response in said direction on the above mentioned surface. The same operations are repeated separately for each sound source. The sound which is reproduced to the user is the sum of the sound from all three sound sources, and in this sum each sound has been filtered with a filter modeling how said sound is directed.

According to the invention we can, in addition to the actual sound sources, also model sound reflections, particularly early reflections. In FIG. 5 there is formed by an image source method known per se an image source 506 represents how the sound transmitted by the sound source 503 is reflected from an adjacent wall. This image source can be processed according to the invention in exactly the same way as the actual sound sources, in other words we can determine for it the direction of the zero azimuth and the sound directivity (frequency dependent, when required) in directions differing from the zero azimuth direction. The receiving device reproduces the sound "generated" by the image source by the same principle as it uses for the sound generated by the actual sound sources.

Figure 6:
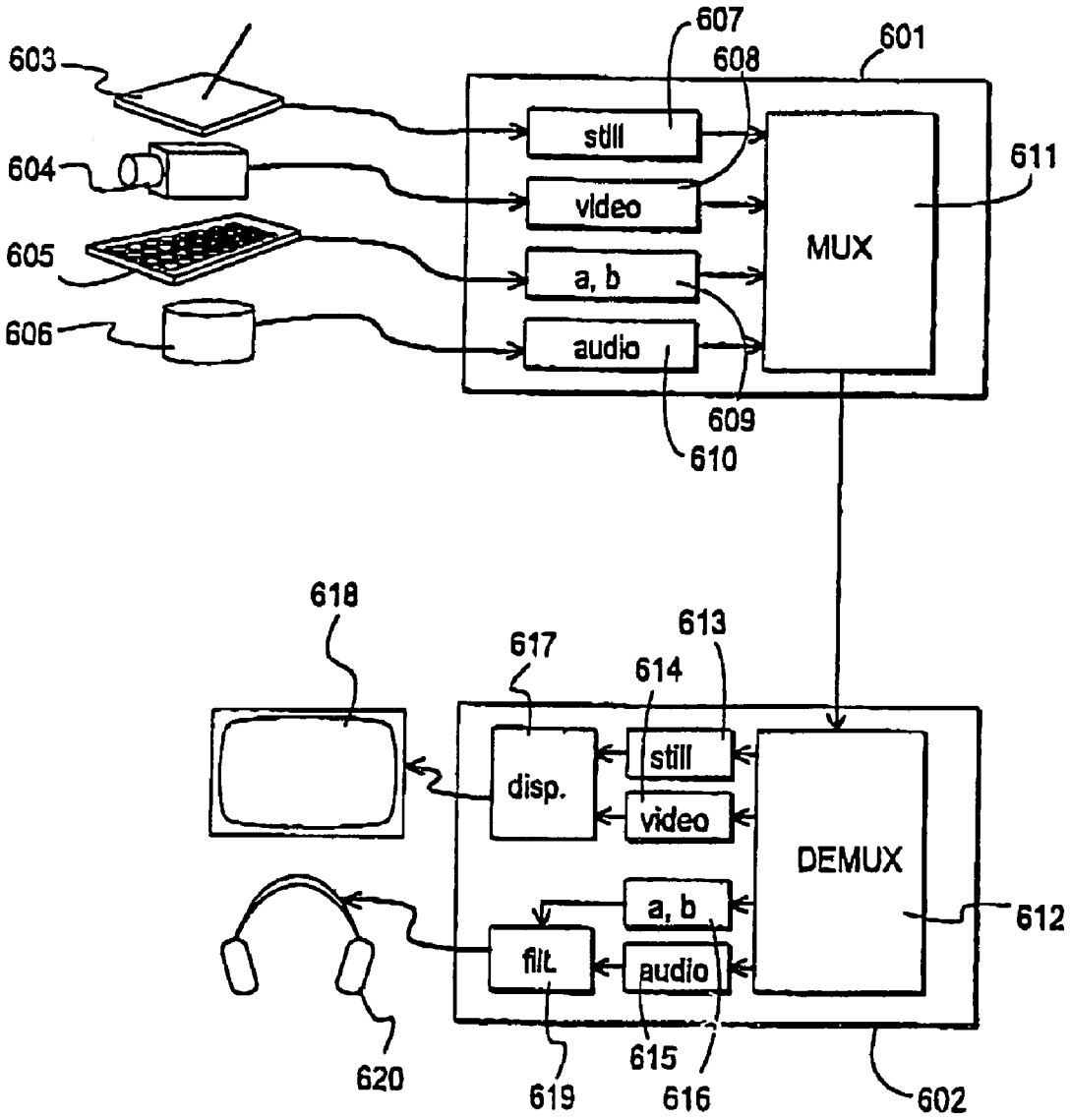
FIG. 6 shows a system according to the invention.

FIG. 6 shows a system having a sitting device 601 and a receiving device 602. The transmitting device 601 generates a certain acoustic virtual environment which comprises at least one sound source and the acoustic characteristics of at least one space, and it transmits the environment in some form to the receiving device 602. The transmission can be effected for instance as a digital radio or television broadcast, or via a data network. The transmission can also mean that the transmitting device 601 generates a recording such as a DVD disc (Digital Versatile Disc) on the basis of the acoustic virtual environment which it has generated, and the user of the receiving device acquires this recording for his use. A typical application delivered as a recording could be a concert where the sound source is an orchestra comprising virtual instruments and the space is an electrically modeled imagined or real concert hall, whereby the user of the receiving device with his equipment can listen to how the performance sounds in different places of the hall. If this virtual environment is audiovisual then it also comprises a visual section realized by computer graphics. The invention does not require that the transmitting device and the receiving device are different devices, but the user can create a certain acoustic virtual environment in one device and use the same device for examining his creation.

In the embodiment presented in FIG. 6 the user of the transmitting device creates a certain visual environment, such as a concert hall with the aid of the computer graphics tools 603, and a video animation, such as the players and the instruments of a virtual orchestra with corresponding tools 604. Further he enters via a keyboard 605 certain directivities for the sound sources of environment which he created, most preferably the transfer functions which represent how the sound is directed depending on the frequency. The modeling of how the sound is directed can also be based on measurements which have been made for real sound sources; then the directivity information is typically read from a database 606. The sounds of the virtual instruments are loaded from the database 606. The transmitting device processes the information entered by the user into bit streams in the blocks 607, 608, 609 and 610, and combines the bit streams into one data stream in the multiplexer 611. The data stream is supplied in some form to the receiving device 602 where the demultiplexer 612 from the data stream separates the image section representing the static environment into the block 613, the time dependent image section or the animation into the block 614, the time dependent sound into the block 615, and the coefficients representing the surfaces into the block 616. The image sections are combined in the display driver block 617 and supplied to the display 618. The signals representing the sound transmitted by the sound sources are supplied from the block 615 into the filter bank 619 having filters with transfer functions which are reconstructed with the aid of the a and b parameters obtained from the block 616. The sound generated by the filter bank is supplied to the headset 620.

Figure 7B:
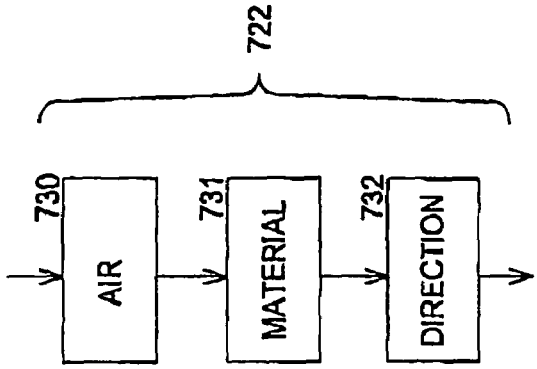
FIG. 7*b* shows a detail of FIG. 7*a*.
Figure 7A:
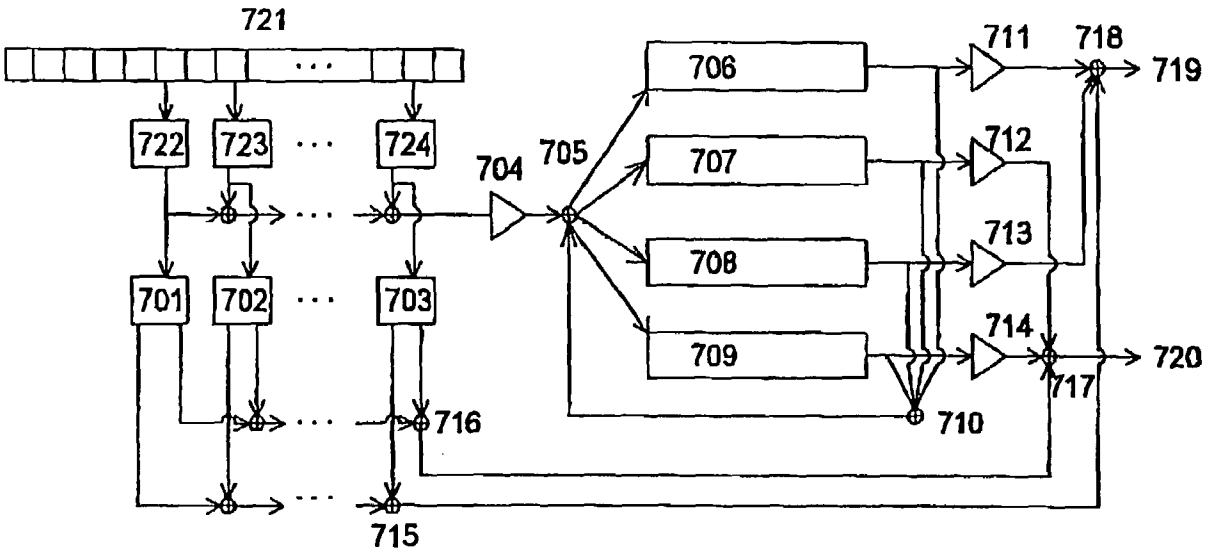
FIG. 7*a* shows in more detail a part of a system according to the invention.

The FIGS. 7*a* and 7*b* show in more detail a filter arrangement of the receiving device with which it is possible to realize the acoustic virtual environment in the manner according to the invention. Also other factors related to the sound processing are taken into account in the figures, and not only the sound directivity modeling according to the invention. The delay means 721 generates the mutual time differences of the different sound components (for instance the mutual time differences of sounds which have been reflected along different paths, or of virtual sound sources located at different distances). At the same time the delay means 721 operates as a demultiplexer which directs the correct sounds into the correct filters 722, 723 and 724. The filters 722, 723 and 724 are parametrized filters which are described in more detain in FIG. 7*b*. The signals supplied by them are on one hand branched to the filters 701, 702 and 703, and on the other hand via adders and an amplifier 704 to the adder 705, which together with the echo branches 706, 707, 708 and 709 and the adder 710 and the amplifiers 711, 712, 713 and 714 form a coupling known per se with which post-echo can be generated to a certain signal. The filters 701, 702 and 703 are directional filters known per se which take into account the differences of the listener's auditory perception in different directions, for instance according to the HRTF model (Head-Related Transfer Function). Most advantageously the filters 701, 702 and 703 also contain so called ITD delays (Interaural Time Difference) which model the mutual time difference of the sound components arriving from different directions to the listener's ears.

In the filters 701, 702 and 703 each signal component is divided into the right and the left channels, or in a multichannel system generally into N channels. All signals related to a certain channel are combined in the adder 715 or 716 and directed to the adder 717 or 718, where the post-echo belonging to each signal is added to the signal. The lines 719 and 720 lead to the speakers or to the headset. In FIG. 7*a* the points between the filters 723 and 724 and the filters 702 and 703 mean that the invention does not limit how many filters there are in the filter bank of the receiving device. There may be even hundreds or thousands of filters, depending on the complexity of the modeled acoustic virtual environment.

FIG. 7*b* shows in more detail a possibility to realize the parametrized filter 722 shown in FIG. 7*a*. In FIG. 7*b* the filter 722 comprises three successive filter stages 730, 731 and 732, of which the first filter stage 730 represents the propagation attenuation in a medium (generally air), the second stage 731 represents the absorption occurring in the reflecting material (it is applied particularly in modeling the reflections), and the third stage 732 takes into account both the distance which the sound propagates in the medium from the sound source (possibly via a reflecting surface) to the examination point and the characteristics of the medium, such as the humidity, pressure and temperature of the air. In order to calculate the distance the first stage 730 obtains from the transmitting device information about the location of the sound source in the coordinate system of the space to be modeled, and from the receiving device information about the coordinates of the that point which the user has chosen as the examination point. The first stage 730 obtains the data describing the characteristics of the medium either from the transmitting device or from the receiving device (the user of the receiving device can be enabled to set desired medium characteristics). As a default the second stage 731 obtains from the transmitting device a coefficient describing the absorption of the reflecting surface, though also in is case the user of the receiving device can be given a possibility to change the characteristics of the modeled space. The third stage 732 takes into account how the sound transmitted by the sound source is directed from the sound source into different directions in the modeled space; thus the third stage 732 realizes the invention presented in this patent application.

Above we have generally discussed how the characteristics of the acoustic virtual environment can be processed and transmitted from one device to another device by using parameters. In the following we discuss how the invention is applied to a certain data transmission form. Multimedia means a mutually synchronized presentation of audiovisual objects to the user. It is thought that interactive multimedia presentations will come into large-scale use in future, for instance as a form of entertainment and teleconferencing. From prior art there are known a number of standards which define different ways to transmit multimedia programs in an electrical form. In this patent application we discuss particularly the so called MPEG standards (Motion Picture Experts Group), of which the MPEG-4 standard being prepared at the time when this patent application is filed has as an aim that the transmitted multimedia presentation can contain real and virtual objects, which together form a certain audiovisual environment. The invention is not in any way limited to be used only in connection with the MPEG-4 standard, but it can be applied for instance in the extensions of the VRML97 standard, or even in fixture audiovisual standards which are unknown for the time being.

A data stream according to the MPEG-4 standard comprises multiplexed audiovisual objects which can contain a section which is continuous in time (such as a synthesized sound) and parameters (such as the location of the sound source in the space to be modeled). The objects can be defined to be hierarchic, whereby so called primitive objects are on the lowest level of the hierarchy. In addition to the objects a multimedia program according to the MPEG-4 standard includes a so called scene description which contains such information relating to the mutual relations of the objects and to the arrangement of the general setting of the program, which information most advantageously is encoded and decoded separately from the actual objects. The scene description is also called the BIFS section (Binary Format for Scene description). The transmission of an acoustic virtual environment according to the invention is advantageously realized by using the structured audio language defined in the MPEG-4 standard (SAOL/SASL. Structured Audio Orchestra Language/Structured Audio Score Language) or the VRML97 language.

In the above mentioned languages there is at present defined a Sound node which models the sound source. According to the invention it is possible to define an extension of a known Sound node, which in this patent application is called a DirectiveSound node. In addition to the known Sound node it further contains a field, which here is called the directivity field and which supplies the information required for reconstruct the filters representing the sound directivity. Three different alternatives for modeling the filters were presented above, so below we describe how these alternatives appear in the directivity field of a DirectiveSound node according to the invention.

According to the first alternative each filter modeling a direction different from a certain zero azimuth corresponds to a simple multiplication by an amplification factor being a standardized real number between 0 and 1. Then the contents of the directivity field could be for instance as follows:

((0.79 0.8) (1.57 0.6) (2.36 0.4) (3.14 0.2))

In this alternative the directivity field contains as many number pairs as there are directions differing from the zero azimuth in the sound source model. The first number of a number pair indicates the angle in radians between the direction in question and the zero azimuth, and the second number indicates the amplification factor in said direction.

According to the second alternative the sound in each direction differing from the direction of the zero azimuth is divided into frequency bands, of which each has its own amplification factor. The contents of the directivity field could be for instance as follows:

((0.79 125.0 0.8 1000.0 0.6 4000.0 0.4)

(1.57 125.0 0.7 1000.0 0.5 4000.0 0.3)

(2.36 125.0 0.6 1000.0 0.4 4000.0 0.2)

(3.14 125.0 0.5 1000.0 0.3 4000.0 0.1))

In this alternative the directivity field contains as many number sets, separated from each other by the inner parentheses, as there are directions differing from the direction of the zero azimuth in the sound source model. In each number set the first number indicates the angle in radians between the direction in question and the zero azimuth. After the first number there are number pairs, of which the first one indicates a certain frequency in hertz and the second is the amplification factor. For instance the number set (0.79 125.0 0.8 1000.0 0.6 4000.0 0.4) can be interpreted so that in the direction 0.79 radians an amplification factor of 0.8 is used for the frequencies 0 to 125 Hz, an amplification factor of 0.6 is used for the frequencies 125 to 1000 Hz, and an amplification factor of 0.4 is used for the frequencies 1000 to 4000 Hz. Alternatively it is possible to use a notation where the above mentioned number set means that in the direction 0.79 radians the amplification factor is 0.8 at the frequency 125 Hz, the amplification factor is 0.6 at the frequency 1000 Hz, and the amplification factor is 0.4 at the frequency 4000 Hz, and the amplification factors at other frequencies are calculated from these by interpolation and extrapolation. Regarding the invention it is not essential which notation is used, as long as the used notation is known to both the transmitting device and the receiving device.

According to the third alternative a transfer function is applied in each direction differing from the zero azimuth, and in order to define the transfer function there are given the a and b coefficients of its Z-transform. The contents of the directivity field could be for instance as follows:

$((45\ b_{45,0}\ b_{45,1}\ a_{45,1}\ b_{45,2}\ a_{45,2}\ \ldots)$ $(90\ b_{90,0}\ b_{90,1}\ a_{90,1}\ b_{90,2}\ a_{90,2}\ \ldots)$ $(135\ b_{135,0}\ b_{135,1}\ a_{135,1}\ b_{135,2}\ a_{135,2}\ \ldots)$ $(180\ b_{180,0}\ b_{180,1}\ a_{180,1}\ b_{180,2}\ a_{180,2}\ \ldots))$ In this alternative the directivity field also contains as many number sets, separated from each other by the inner parentheses, as there are directions differing from the direction of the zero azimuth in the sound source model. In each number set the first number indicates the angle, this time in degrees, between the direction in question and the zero azimuth; in this case, as also in the cases above, it is possible to use any other known angle units as well. After the first number there are the a and b coefficients which determine the Z-transform of the transfer function used in the direction in question. The points after each number set mean that the invention does not impose any restrictions on how many a and b coefficients define the Z-transforms of the transfer function. In different number sets there can be a different number of a and b coefficients. In the third alternative the a and b coefficients could also be given as their own vectors, so that an efficient modeling of FIR or all-pole-IIR filters would be possible in the same way as in the publication Ellis, S. 1998: "Towards more realistic sound in VMRL". Proc. VRML '98, Monterey, USA, Feb. 16-19, 1998, pp. 95-100.

The above presented embodiments of the invention are of course only intended as examples, and they do not have any effect of restricting the invention. Particularly the manner in which the parameters representing the filters are arranged in the directivity field of the DirectiveSound node can be chosen in very many ways.

The invention claimed is:

1. A method for processing directed sound in an acoustic virtual environment in an electronic device, said acoustic virtual environment comprising at least one sound source, the method comprising:

attaching a reference direction and a set of selected directions to the at least one sound source, each selected direction differing from said reference direction, establishing a direction dependent filtering arrangement having at least one parameter disposed to at least partly determine a filtering effect of the direction dependent filtering arrangement, said at least one parameter enabling the direction dependent filtering arrangement to model that said at least one sound source radiates a different sound to said reference direction than to a direction that deviates from said reference direction, for each selected direction defining at least one value for each of said at least one parameter, and filtering, with the direction dependent filtering arrangement, a signal that represents sound propagating from said at least one sound source in said reference direction in order to produce a signal that represents sound propagating from said at least one sound source in said direction that deviates from said reference direction.

2. A method according to claim 1, wherein the establishing the direction dependent filtering arrangement comprises associating a filter with each selected direction so that a filtering effect of a filter relating to each selected direction depends on the at least one value of said at least one parameter relating to the selected direction in question.

3. A method according to claim 1, wherein the at least one value of said at least one parameter relating to a certain selected direction determines an amplification factor that is disposed to determine amplification of the signal representing the sound emitted by said at least one sound source when listened to from a direction corresponding with the selected direction in question.

4. A method according to claim 1, wherein the at least one value of said at least one parameter relating to a certain selected direction determine separate amplification factors that are disposed to determine amplifications for different frequencies of the signal representing the sound emitted by said at least one sound source when listened from a direction corresponding with the selected direction in question.

5. A method according to claim 1, wherein the values of said at least one parameter relating to a certain selected direction are the coefficients $[b_0\ b_1\ a_1\ b_2\ a_2]$ of the quotient expression $$H(z) = \frac{Y(z)}{X(z)} = \frac{\sum_{k=0}^{M} b_k z^{-k}}{1 + \sum_{k=1}^{N} a_k z^{-k}}$$

that is disposed to determine a Z-transform of a transfer function of the direction dependent filtering arrangement, X representing the z-transform of the signal representing the sound emitted by said at least one sound source, Y representing the Z-transform of a signal representing the sound listened from a direction corresponding with the selected direction in question, M and N being upper limits for defining accuracy at which it is desired to define the transfer function, z representing a Z-transform variable, and k being a summation index.

6. A method according to claim 2, comprising interpolation between said filters in order to model how the sound emitted by said at least one sound source sounds when listened to from a direction that differs from the reference direction and each selected direction.

7. A method according to claim 1, comprising:

generating in a transmitting device said acoustic virtual environment comprising said at least one sound source, performing in the transmitting device, defining the reference direction and the set of selected directions, establishing the direction dependent filtering arrangement having said at least one parameter, and the defining said at least one value of said at least one parameter for each selected direction, transmitting from said transmitting device to a receiving device information about the direction dependent filtering arrangement, receiving in the receiving device said information about the direction dependent filtering arrangement, reconstructing in the receiving device the direction dependent filtering arrangement on the basis of said information, and performing in the receiving device, filtering the signal representing the sound emitted by the at least one sound source with the direction dependent filtering arrangement.

8. A method according to claim 7, wherein the transmitting device transmits to the receiving device information about the direction dependent filtering arrangement as a part of a data stream according to the MPEG-4 standard.

9. A method according to claim 1, wherein at least one sound source is a real sound source.

10. A method according to claim 1, wherein at least one sound source is a reflection.

11. A system for processing directed sound in an acoustic virtual environment in an electronic device, said acoustic virtual environment comprising at least one sound source, the system comprising:

means for attaching a reference direction and a set selected directions to the at least one sound source, each selected direction differing from said reference direction, a direction dependent filtering arrangement disposed to filter a signal that represents sound propagating from said at least one sound source in said reference direction in order to produce a signal that represents sound propagating from said at least one sound source in a direction that deviates from said reference direction, the direction dependent filtering arrangement having at least one parameter disposed to at least partly determine a filtering effect of the direction dependent filtering arrangement, said at least one parameter enabling the direction dependent filtering arrangement to model that said at least one sound source radiates a different sound to said reference direction than to said direction that deviates from said reference direction, and means for associating a value for each of said at least one parameter with each selected direction.

12. A system according to claim 11, comprising a transmitting device and a receiving device and means for realizing an electrical communication between the transmitting device and the receiving device.

13. A system according to claim 12, comprising multiplexing means in the transmitting device for adding data describing the direction dependent filtering arrangement to a data stream according to the MPEG-4 standard, and de-multiplexing means in the receiving device for extracting said data describing the direction dependent filtering arrangement from the data stream according to the MPEG-4 standard.

14. A system according to claim 12, comprising multiplexing means in the transmitting device for adding data describing the direction dependent filtering arrangement to a data stream according to the extended VRML97 standard, and de-multiplexing means in the receiving device for extracting said data describing the direction dependent filtering arrangement from the data stream according to the extended VRML97 standard.

15. An electronic device for processing directed sound of an acoustic virtual environment, the acoustic virtual environment comprising at least one sound source, the electronic device comprising:

circuitry that attaches a reference direction and a set of selected directions to the at least one sound source, each selected direction differing from the reference direction, a direction dependent filtering arrangement that filters a signal that represents sound propagating from the at least one sound source in the reference direction in order to produce a signal that represents sound propagating from the at least one sound source in a direction that deviates from the reference direction, the direction dependent filtering arrangement having at least one parameter that at least partly determines a filtering effect of the direction dependent filtering arrangement, the at least one parameter enabling the direction dependent filtering arrangement to model that the at least one sound source radiates a different sound to the reference direction than to the direction that deviates from the reference direction, and circuitry that associates a value for each of said at least one parameter with each selected direction.

16. A system for processing directed sound in an acoustic virtual environment in an electronic device, the acoustic virtual environment comprising at least one sound source, the system comprising:

circuitry that attaches a reference direction and a set of selected directions to the at least one sound source, each selected direction differing from the reference direction, a direction dependent filtering arrangement that filters a signal that represents sound propagating from the at least one sound source in the reference direction in order to produce a signal that represents sound propagating from the at least one sound source in a direction that deviates from the reference direction, the direction dependent filtering arrangement having at least one parameter disposed to at least partly determine a filtering effect of the direction dependent filtering arrangement, the at least one parameter enabling the direction dependent filtering arrangement to model that the at least one sound source radiates a different sound to the reference direction than to the direction that deviates from the reference direction, and circuitry that associates a value for each of the at least one parameter with each selected direction.

* * * * *